United States Patent [19]

Cosmo

[11] 3,971,553

[45] July 27, 1976

[54] AUTOMATIC SHEET CHANGING SYSTEM FOR REPROGRAPHIC MACHINES

[75] Inventor: Nicola Cosmo, Ivrea (Turin), Italy

[73] Assignee: Ing. C. Olivetti & C., S.p.A., Ivrea (Turin), Italy

[22] Filed: Aug. 26, 1975

[21] Appl. No.: 607,868

[30] Foreign Application Priority Data

Sept. 2, 1974 Italy ..... 69662/74

[52] U.S. Cl. ..... 271/3; 271/8 A; 271/257; 271/258; 271/82; 271/DIG. 2; 242/67.3 R

[51] Int. Cl.[2] ..... B65H 5/12

[58] Field of Search ..... 271/3, 4, 10, 256, 257, 271/258, 82, DIG. 2, 8 A; 242/67.3 R, 67.4

[56] References Cited

UNITED STATES PATENTS 3,191,882 6/1965 Riedel ..... 242/67.3 R 3,743,200 7/1973 Hommerin ..... 242/67.3

*Primary Examiner*—Richard A. Schacher

*Attorney, Agent, or Firm*—I. J. Schaefer

[57] ABSTRACT

An automatic sheet changing system for a reprographic machine comprising a cyclically movable, sheet transporting member having gripping elements for retaining a sheet thereon, a support band wound from a feed reel to a take-up reel and carrying thereon sheets spaced along and interwound with the band, recovery means operative in a sheet changing cycle to remove a used sheet from the sheet-transporting member, feed means operable in the sheet changing cycle to wind a length of the band off the feed reel on to the take-up reel, means operative to separate a fresh sheet from the band advancing between the reels and to guide the sheet to the gripping elements, and means for actuating the gripping elements to grip the fresh sheet.

10 Claims, 5 Drawing Figures

AUTOMATIC SHEET CHANGING SYSTEM FOR REPROGRAPHIC MACHINES

BACKGROUND OF THE INVENTION

The present invention relates to an automatic sheet changing system for reprographic machines. The system is applicable for the feed and automatic recovery of sheets in all those reprographic machines in which there is periodically required the changing of sheets, normally of special material, which must be specially protected from dust or light or heat, or from other external agents which could damage them before becoming operative, that is before their use in the machine.

An example of application of the system according to the invention is that where the sheets are photoconductive masters or copy sheets to be employed to form images on ordinary paper in electrophotographic copying machines. In these machines, the latent image of the original to be reproduced is produced on a master sheet of photoconductive material wrapped round a drum or positioned on some other cyclically movable member, is rendered visible by means of known developing operations and is then transferred to a sheet of ordinary paper forming the finished copy of the original after a fixing operation. Each of these masters, depending on the layer of photoconductor of which it is formed, can be used for a number of copying cycles ranging from some hundreds to some thousands, after which it must be replaced.

An object of the present invention is to provide a system for automatically changing sheets such as masters in reprographic machines in which the supply of fresh sheets can be effected by the casual user.

SUMMARY OF THE INVENTION

According to the present invention there is provided an automatic sheet changing system for a reprographic machine comprising a cyclically movable, sheet-transporting member having gripping elements for retaining a sheet thereon, a support band wound from a feed reel to a take-up reel and carrying thereon sheets spaced along and interwound with the band, recovery means operative in a sheet changing cycle to remove a used sheet from the sheet-transporting member, feed means operable in the sheet changing cycle to wind a length of the band off the feed reel on to the take-up reel, means operative to separate a fresh sheet from the band advancing between the reels and to guide the sheet to the gripping elements, and means for actuating the gripping elements to grip the fresh sheet.

BRIEF DESCRIPTION OF THE DRAWINGS

The invention will be described in more detail, by way of example, with reference to the accompanying drawings, wherein:

FIG. 1*a* is a partial plan view of a system embodying the invention;

FIG. 1 shows the way in which FIGS. 1*a* and 1*b* are assembled;

DETAILED DESCRIPTION OF THE PREFERRED EMBODIMENT

Figures 1, 1A, 1B:
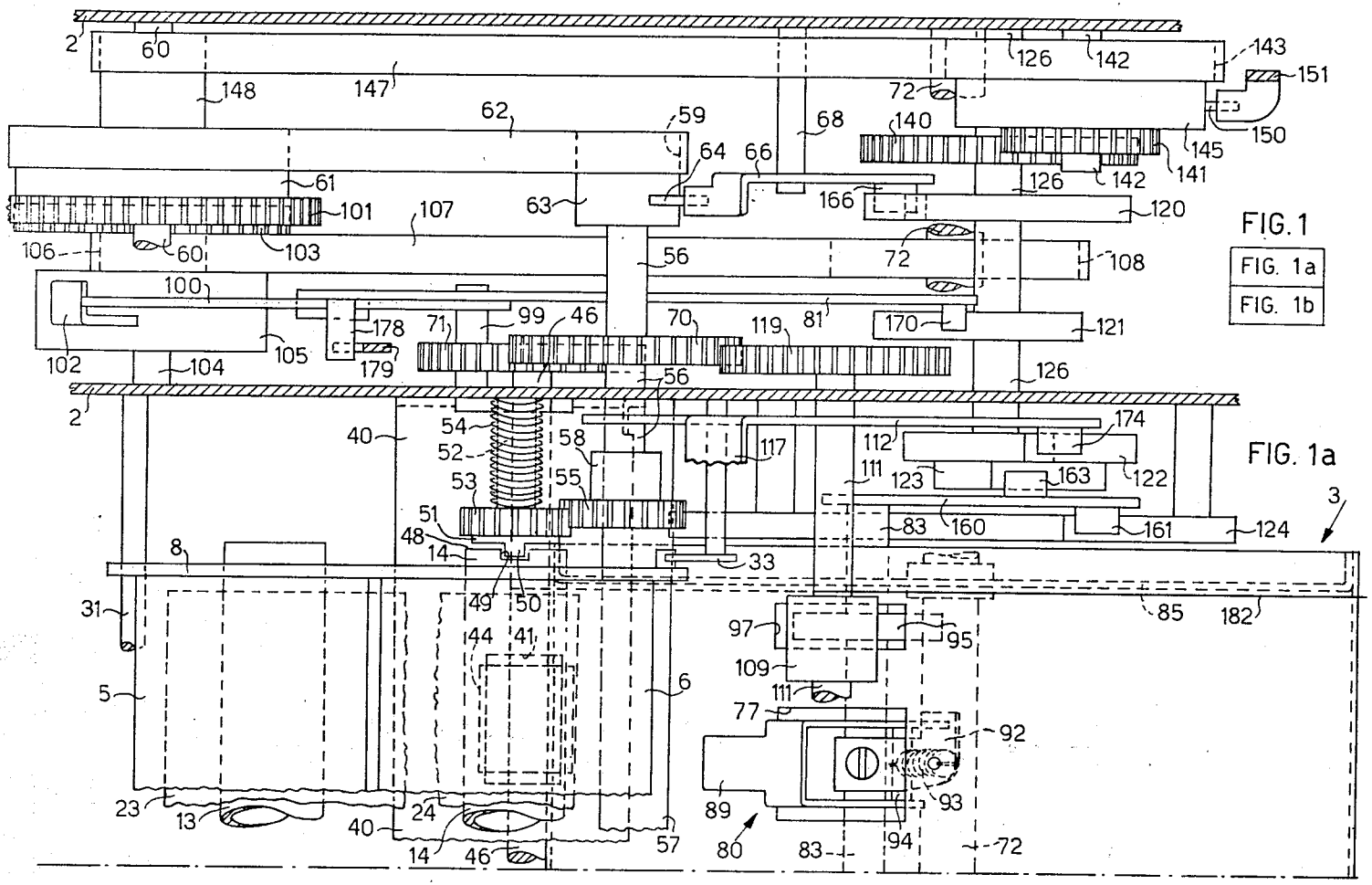
Figure 1B:
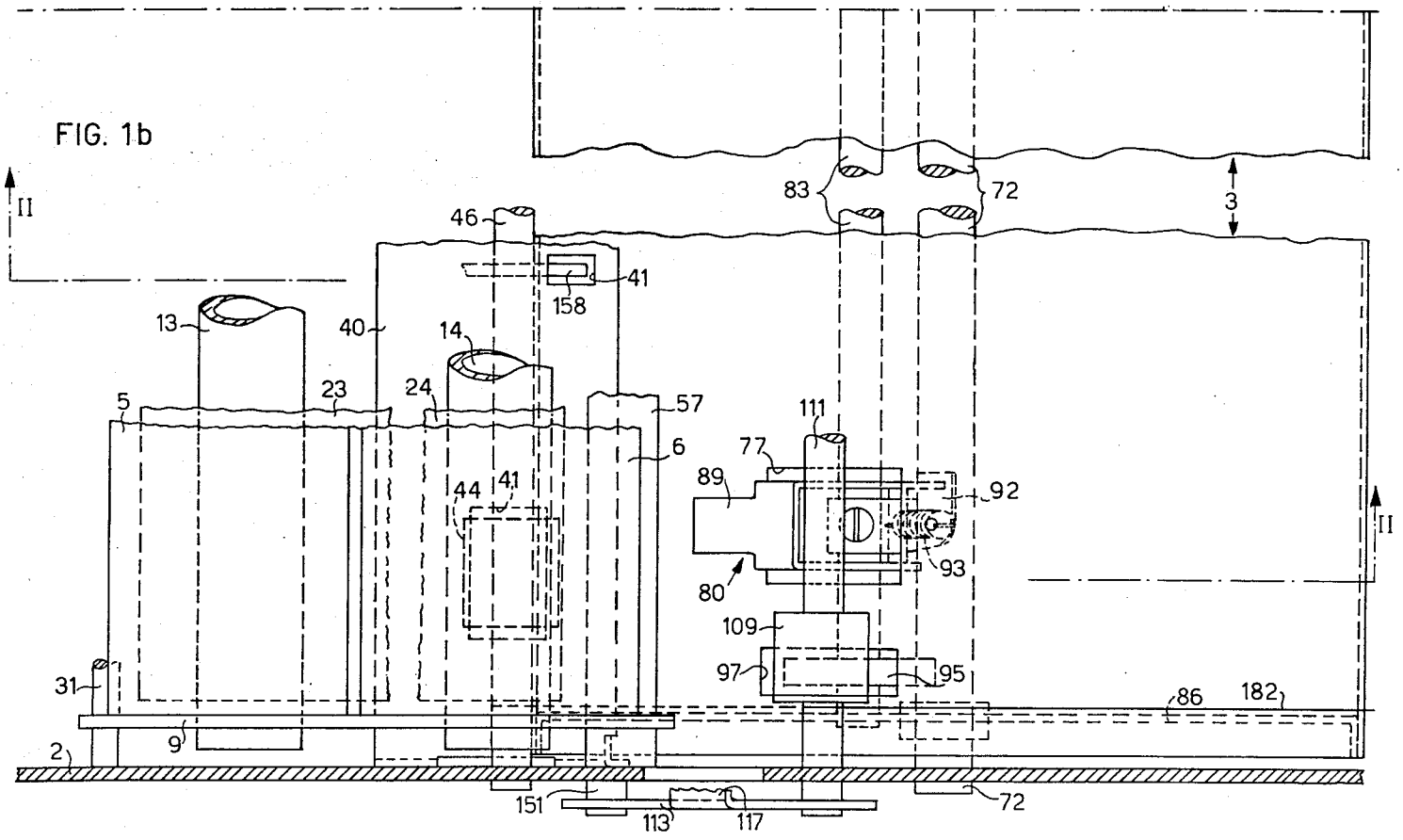
FIG. 1*b* is a further partial plan view of the system.
Figure 2:
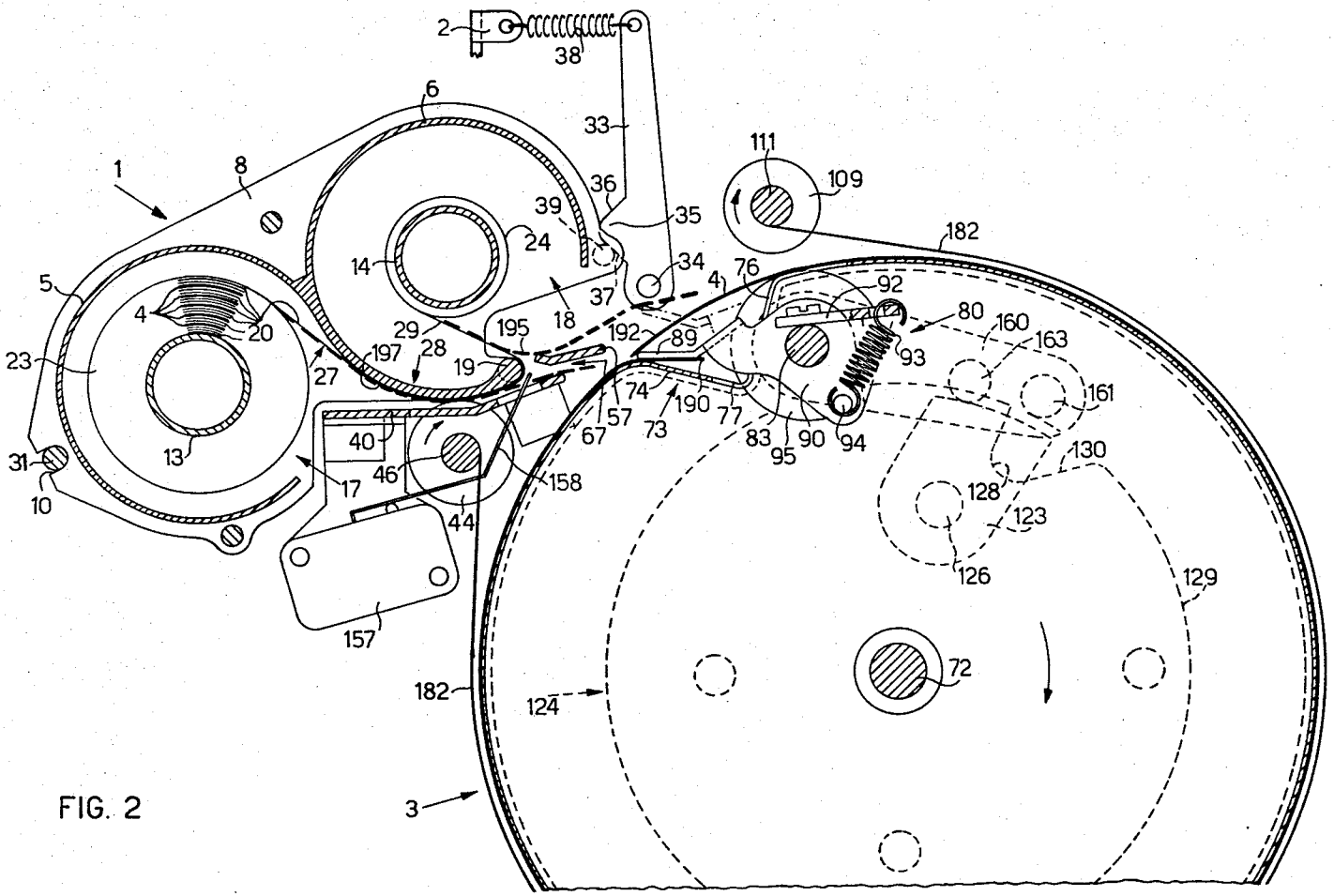
FIG. 2 is a section along the line II—II of the system of FIG. 1.

Referring to FIGS. 1*a*, 1*b* and 2, the system includes a cartridge 1 shown in these Figures positioned in the operative stage on a reprographic machine with a frame 2 and adjacent a drum 3 of the machine. Around the drum 3 there is wound or wrapped a sheet 4 of special material required for reproduction purposes; as an example, the drum 3 may be regarded, as already stated, as the electrophotographic drum of an electrophotographic copier using ordinary paper, with the sheet 4 being a master consisting of photoconductive material. The cartridge 1 constitutes the container for the fresh masters to be fed to the drum 3 and for the used masters recovered from the drum 3 in each master changing operation.

The cartridge 1 comprises two substantially cylindrical containers 5 and 6 integral with each other and having parallel axes and defined at opposite ends by two similarly shaped lateral flanges 8 and 9 each having a substantially semicircular notch 10. Two cylinders 13 and 14 are journalled inside the containers 5 and 6, respectively, in the flanges 8 and 9 coaxially with the containers and are free to rotate about their own axes. The containers 5 and 6 have openings 17 and 18 extending axially over their entire length (FIG. 2). The end 19 of the wall of the container 6, which defines the opening 18 at the bottom thereof, is rounded.

On the cylinders 13 and 14 a band 20 of flexible material is wound so as to form two reels 23 and 24, the first being the feed reel and the second the rewinding reel. As the cylinders rotate clockwise in FIG. 2, the band winds off the reel 23 on to the reel 24.

That portion of the band 20 which is between the two reels 23 and 24 is compelled to follow a path which, starting from the reel 23, comprises a first rectilinear length 27 extending through the opening 17 until it is tangent to the outer surface of the container 6, a second length 28 riding round the surface of the container 6 until it enters the interior of the container 6 through the opening 18, turning around the end 19 and executing a sharp reversal of direction, and finally a third rectilinear length 29 from the end 19 to the take-up reel 24.

Sheets of material 4 forming, as already stated, the masters to be fed to the drum 3 to be wrapped around it, are positioned on the band 20, before this is wound on the cylinder 13 to form the feed reel 23, in such manner that the sheets are regularly spaced along the band. The width of the band 20 is at least equal to the width of the master sheets 4. The distance of the band between two consecutive sheets must be kept greater than the length of each of the sheets 4 themselves for reasons which will become clear below. The sheets 4 are therefore interwound with the band to form the feed reel 23. Initially, with a "full" cartridge 1, the rewinding reel 24 is formed only by a few turns of band 20, while it will become gradually larger during use because the used masters recovered from the drum 3 are wound on it.

The nature of the band 20 is dependent both on the nature of the material of which the sheets 4 are composed, inasmuch as a first task of the band 20 is to act as a protective support for the sheets 4 themselves, with sufficient tensile strength to avoid tearing, while a second task is to act as a conveyor for feeding the sheets 4 from the feed reel 23 to the drum 3 around which they are to be wound and for recovering the used master sheet from the drum 3 to deliver it to the rewinding reel 24. In the case of a photoconductive master sheet 4, the band 20 may be of ordinary paper, provided that it is strong enough.

For positioning the cartridge 1 on the reprographic machine, there are provided a rod 31 (FIGS. 1*a* and 1*b*) fixed to the frame 2 of the machine and a positioning lever 33 pivoted on a pin 34 fast with the frame 2 and comprising a projection 35 having a first working surface 36 (FIG. 2) and a second working surface 37 which are adapted to co-operate with a stud 39 fast with the flange 8 of the cartridge 1 during the insertion and removal of the cartridge 1. A spring 38 is tensioned between the lever 33 and the frame 2. The rod 31 fits in the notches 10.

Also assisting in defining the seat for positioning the cartridge 1 on the machine is a first plate 40 fixed to the frame 2 and co-operating with the outer wall of the container 6 of the cartridge 1, when inserted, and with a second plate, a separator plate 57, fixed to the frame 2 for defining a guide for the course taken by the master 4 conveyed by the band 20 from the feed reel 23 to the drum 3.

The plate 40 extends laterally over the entire width of the cartridge 1 and has two rectangular holes 41 aligned parallel to the direction of the axes of the two containers 5 and 6. Two rollers 44 are keyed on a spindle 46 mounted rotatably in the frame 2 below the plate 40 (FIG. 2) and extending parallel to the axes of the containers 5 and 6 with the cartridge 1 inserted. The rollers 44 are keyed on the spindle 46 in coincidence with the holes 41 overhead and have an axial extent less than that of the holes 41 and a diameter such that they project through these holes 41 at the top of the plate 40 itself to co-operate with the outer wall of the container 6, with the cartridge 1 inserted, in the feed of the band 20 and the master 4 conveyed by the band from the feed reel 23 to the rewinding reel 24.

The positioning of the cartridge 1 on the reprographic machine is therefore effected by fitting the notches 10 in the flanges 8 and 9 over the rod 31 and turning the cartridge 1 clockwise (with reference to FIG. 2) until the stud 39 engages the working surface 36 of the projection 35 of the lever 33; by exerting a slight pressure on the cartridge in the direction or rotation, this latter engagement causes the stretching of the spring 38 and a further rotation of the cartridge 1 until the outer wall of the container 6 and the band 20 adjacent thereto bear against the rollers 44. At the same time, engagement of the stud 39 with the working surface 36 having ceased and the lever 33 having returned to the position thereof shown in the drawing, the stud 39 engages the working surface 37 of the projection 35 of the lever 33 and this engagement, combined with the action of the spring 38, which tends to cause the lever to turn anticlockwise, ensures the holding of the cartridge 1 in its operative position.

In the end 48 of the cylinder 14 of the cartridge 1 there is formed a diametral groove 49 (FIG. 1*a*) which is adapted to co-operate, the cartridge 1 being inserted, with a corresponding projection 50 of a driving disc 51 which is free to rotate on a pin 52 fixed to the frame of the machine. The driving disc 51 is fast with a gear 53 free to rotate on the same pin 52 and to slide axially, fast with the driving disc 51, with respect to the pin 52; a spring 54 tensioned axially between the frame of the machine 2 and the gear 53 biases the driving disc 51 into engagement by means of its projection 50 with the groove 49 of the cylinder 14. The driving disc 51 transmits motion from the gear 53 to the cylinder 14 for the unwinding of band 20 from the reel 23 and corresponding rewinding on the reel 24.

It may happen, however, that on insertion of the cartridge 1 the driving disc 51 does not have the projection 50 positioned so as to engage the groove 49. In this case, they snap into engagement after a fraction of a revolution of the driving disc 51 sufficient to align the projection 50 with the groove 49.

Figure 3:
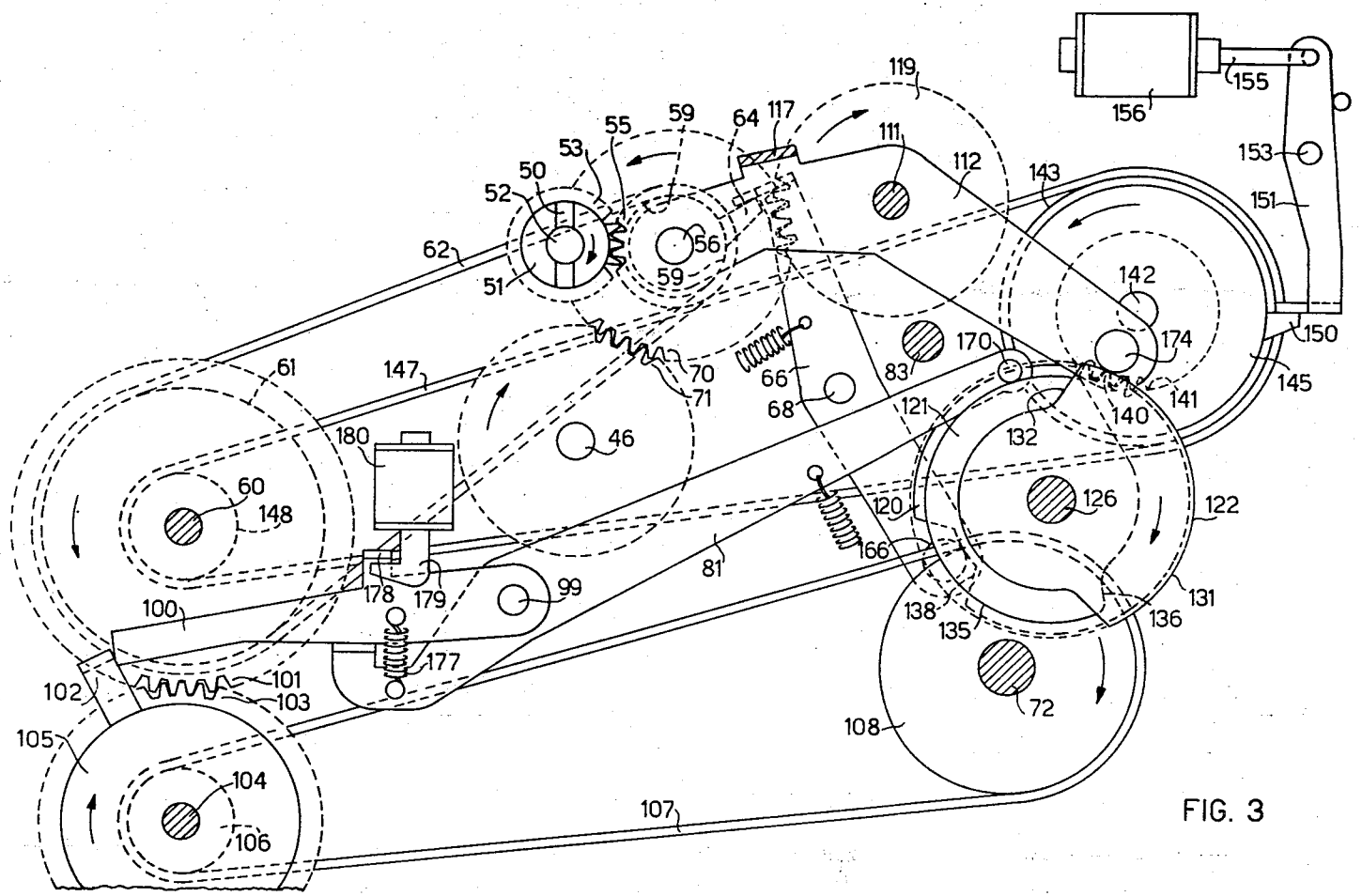
FIG. 3 is a partial front view of the system of FIG. 1.

The gear 53 receives its motion from a gear 55 mounted idly on a shaft 56 journalled in the frame 2 of the machine. The gear 55 receives its motion from a clutch 58 of known type keyed on the shaft 56. Mounted idly on the shaft 56 is a pulley 59 which receives its motion from a driving shaft 60 through a pulley 61 keyed on the shaft 60 and a belt 62 which couples the two pulleys 59 and 61 (see also FIG. 3).

A coupling device 63 of known type provided with a control dog 64 and mounted on the shaft 56 between the pulley 59 and the clutch 58 allows selective transmission of the motion from the pulley 59 to the shaft 56 and therefore to the clutch 58. A lever 66 pivoted on a pin 68 fast with the frame 2 of the machine co-operates with the control dog 64 of the coupling 63 to keep the coupling in the state in which the motion is not transmitted between the pulley 59 and the shaft 56.

A gear 70 is also keyed on the shaft 56 and meshes with a gear 71 keyed on the spindle 46 for transmission of the motion to the spindle and to the rollers 44 mounted thereon.

The drum 3 of the reprographic machine on which the master 4 is wound consists of a hollow cylinder closed at its ends by discs 85 and 86 (FIGS. 1*a* and 1*b*) and is keyed on a shaft 72 pivoted to the frame of the machine. The drum 3 has a shaped portion 73 (FIG. 2) comprising a first inclined surface 74 extending back towards the interior of the drum 3 and forming the surface receiving the leading edge of the master sheet 4 which is to be wound on the drum, and a second surface 76 extending in a direction normal to the first surface and having two openings 77 (FIG. 1*a*) which place the outside of the shaped portion in communication with the interior of the drum 3. A pair of clamps 80 for gripping the master 4 are mounted on a spindle 83 which is pivoted to the side walls 85 and 86 of the drum 3 and passes through them and which extends inside the drum 3 in a direction parallel to the axis thereof (FIGS. 1*a* and 1*b*).

The clamps 80 are each composed of a body 90 (FIG. 2) and a gripping element 89 integral with the body 90. Two plates 92 are fixed to the spindle 83 adjacent the clamps 80. A spring 93 is stretched between each plate 92 and a pin 94 fixed to the body 90 of the corresponding clamp 80. On the spindle 83 there are also mounted idly two rollers 95 (FIGS. 1*a* and 1*b*) in coincidence with openings 97 formed in the shell of the drum and having a diameter such as to rotate through the openings 97 tangentially to the outer surface of the drum 3.

Two wires 182 are stretched between the spindles 46 and 111 and are wound partially around the drum 3 close to the ends 85 and 86 thereof. The wires 182 assist in keeping the master 4 wound around the drum 3 closely against the shell thereof. The drum 3 receives its motion from the driving shaft 60 (FIGS. 1*a* and 3) through a gear 101 keyed on the shaft 60 which meshes with a gear 103 keyed on a shaft 104 and connected through the coupling device 105 to a pulley 106 pivoted on the same shaft 104 and coupled by a belt 107 to a pulley 108 keyed on the shaft 72 of the drum 3. The coupling device 105 comprises a control lug 102; a lever 100 pivoted to the frame of the machine on a pivot 99 co-operates with the lug 102 to hold the coupling device 105 in its state in which it does not transmit the motion.

Two rollers 109 (FIGS. 1*a* and 1*b*) are keyed on a spindle 111 which extends parallel to the direction of the axis of the drum 3 and above it is journalled in levers 112 and 113 pivoted on opposite sides with respect to the drum 3 to the frame of the machine on the shaft 56 and on the pin 115, respectively, and connected by a crosspiece 117. The rollers 109 are mounted on the spindle 111 in coincidence with the subjacent rollers 95 and are adapted to co-operate with the latter for the unwinding of the used master 4 from the drum 3. A gear 119 is keyed on the spindle 111 and meshes with the gear 70 keyed on the shaft 56 for the transmission of the motion to the rollers 109.

A system for the control and synchronisation of the mechanical members hereinbefore described is constituted by a set of five cams 120, 121, 122, 123 and 124 (FIGS. 2 and 3), of which the cams 120, 121, 122, 123 are keyed on the same shaft 126 pivoted to the frame of the machine, and the cam 124 is mounted fixedly with respect to the frame of the machine and coaxially with the drum 3.

The profile of the cam 124 is composed of a gap 128 and a circular dwell surface 129 linked to the gap by a slope 130. The active profile of the cam 123 is constituted by a sector having a radius increasing continuously for an amplitude of about 30°. The active profile of the cam 122 comprises a circular arc 131 of about 180° followed by a descending step 132 and a connecting profile. The active profile of the cam 121 comprises an arc of constant radius of about 180° followed by a descending step 136 and a connecting profile. The active profile of the cam 120 comprises a gap 138 extending for about 35° connecting with a circular arc. The shaft 126 of the cams 120 and 124 (FIGS. 1*a* and 3) receives its motion through a gear 140 keyed thereon which is coupled with a gear 141 keyed on a shaft 142. The shaft 142, in turn, receives its motion from a pulley 143 mounted idly thereon via a coupling device 145 which transmits the motion selectively from the pulley 143 to the shaft 142. Finally, the pulley 143 is coupled to the driving shaft 60 through the belt 147 and the pulley 148 keyed on the driving shaft 60.

The transmission ratio between the gear 140 and the gear 141 is one half, so that the cam shaft 126 performs one revolution for every two revolutions performed by the shaft 142 of the coupling 145.

The coupling 145 is provided with a dog 150 for control thereof selectively in its state of transmission or non-transmission of the motion. A lever 151 normally co-operates with the dog 150 to prevent rotation thereof and thus hold the coupling 145 in the state in which it does not transmit the motion. The lever 151 is pivoted to the frame of the machine 2 at the pivot 153 and is connected to the armature 155 of an electromagnet 156.

The electromagnet 156 is electrically connected to a source of electric power not shown in the drawing through a microswitch 157, the sensing element 158 of which is placed in the path of the master 4 at the beginning of the length of guided travel defined by the plates 40 and 57. The microswitch is therefore able to close and energize the electromagnet 156 on the passage of the front of the fresh master 4 to be fed to the drum 3. The electromagnet 156 can also be energized by means of a key provided on the machine and not shown in the drawing, which starts the master changing cycle.

The spindle 83 bearing the clamps 80 is fast at that end thereof which corresponds to the side wall 85 of the drum 3 with a lever 160 which bears fast therewith a first stud 161 and a second stud 163. The lever 160 and the spindle 83 fast therewith are carried along with the drum 3 as it rotates, inasmuch as the spindle 83 is pivoted in the drum.

During the rotation of the drum 3, the stud 161 of the lever 160 is adapted to co-operate with the profile of the fixed cam 124, while the stud 163 is adapted to co-operate with the profile of the cam 123. When the cam 123 engages the stud 163, the position that the lever 160 adopts is such that its stud 161 does not engage in the gap 130 of the cam 124, the lever being supported above this gap by the action of the cam 123 against the stud 163.

The lever 66 controlling the coupling 63 bears fast therewith a stud 166 which co-operates with the profile of the cam 120; the lever 66 engages the control dog 64 of the coupling 63 every time the stud 166 co-operates with the gap 138 of the cam 120 owing to the rotation thereof, holding the coupling 63 under these conditions in the state of non-transmission of the motion. Under initial conditions, that is when the master changing cycle is not activated, the stud 166 engages the gap 138.

A lever 81 pivoted on the pin 99 fixed to the frame of the machine bears at one end a stud 170 which is adapted to co-operate with the profile of the cam 121. The lever 81 is coupled resiliently to the lever 100 by means of a spring 177 and is adapted to co-operate with that lever for control of the coupling 105. The lever 100 moreover bears a projection 178 adapted to co-operate with the armature 179 of an electromagnet 180. Both the electromagnet 180 and the lever 81 are therefore adapted to control the coupling 105.

The lever 81 keeps the lever 100 disengaged from the lug 102 and, therefore, the coupling 105 in its state of transmission of the motion, when the stud 170 co-operates with the descending step 136 or the connecting profile of the cam 121.

The operation of the various devices hereinbefore described during the master changing operations will now be described in detail. Under inoperative conditions or the conditions when the master changing cycle is not activated, the couplings 63, 105 and 145 are open or disengaged. Moreover, the inoperative position of the cams 120 to 123 and of the drum 3 is that indicated in the drawings and therefore the clamps 80 are in their closed position and the rollers 109 are raised. On the other hand, the pulleys 59, 61; 148, 143 are in rotation because they are coupled to the driving shaft 60, which is always in rotation with the machine switched on.

A master 4 is wound anticlockwise around the drum 3 starting from its front or leading edge 190 retained by the closed clamps 80. (The master can be seen only in FIG. 2 and not in FIGS. 1*a* and 1*b*, for reasons of clarity). The length of the master is such that the rear edge 192 of the sheet remains superposed over the shaped portion 73, while the sheet is compelled to adhere to the shell of the drum by the presence of the wires 182.

The master changing cycle is composed of a first stage in which the master currently wound around the drum 3 is recovered from the drum 3 and wound on the take-up reel 24 of the cartridge 1, and a second stage, following the first, in which a fresh master is fed with the aid of the support band 20 from the feed reel 23 of the cartridge 1 to the drum 3 and is wound thereon.

The master changing cycle begins with the pressing by the operator of a key provided on the machine and not shown in the drawings, which produces the energization of the electromagnet 156, the latter disengaging the lever 151 from the dog 150 of the coupling 145 and thus permitting the transmission of the motion from the shaft 142 to the cam shaft 126. The cams are therefore set in clockwise rotation and, after rotation of the cam 120 for a few degrees, the stud 166 of the lever 66 leaves the gap 138 and engages with the circular connecting profile, causing the disengagement of the lever 66 from the control dog 64 of the coupling device 63, which therefore enters into its state of transmission of the motion to the shaft 56 which, in turn, through the gears 53 and 55 and the clutch 58, transmits the motion to the cylinder 14 of the rewinding reel 24 of the cartridge 1 and, through the gears 70 and 71, transmits the motion to the rollers 44. With the cylinder 14 and the rollers 44 rotating, portions of band 20 are unwound from the feed reel 23 and are rewound on the take-up reel 24, while the front of the fresh master is not yet advanced along the band path 27, because during the last preceding master changing cycle the band had stopped just after completing the feed of a fresh master 4 to the drum 3 and, therefore, in view of the distance between the masters positioned on the band 20, the fresh master to be fed is still wound on the feed reel 23.

After a few degrees of rotation of the cam shaft 126 following on the closing or engagement of the coupling 63, the stud 163 loses contact with the profile of the cam 123 and the lever 160 therefore drops with its stud 161 entering the gap in the fixed cam 124, producing clockwise rotation of the spindle 83 and, therefore, of the plates 92 fixed thereto, which, because of the coupling with the clamps 80, due to the springs 93, causes clockwise rotation of the bodies 90 of the clamps 80 and, therefore, the opening thereof, so that the gripping elements 89 adopt the position indicated by the chain-dotted line in FIG. 2.

The rotation of the gripping elements 89 produces the raising of the rear edge 192 of the master 4 wound on the drum 3 from the periphery thereof, this rear edge being therefore raised above the separate plate 57.

With the rotation of the cam shaft 126 continuing, a few degrees after the opening of the clamps 80 the stud 174 of the lever 112 engages with the descending step 132 of the cam 122 and, as already described, there is a lowering of the rollers 109 to co-operate with the subjacent rollers 95 pivoted idly on the spindle 83 mounted on the drum 3 for the advance of the master 4 wound around the drum 3 towards the cartridge 1 and, to be precise, towards the portion of band 20 in the length of path 29. The rear edge of the master 4 advances until it is against this last portion of band 20, following the path 195 shown in heavy dashes in FIG. 2, and is then guided by this band and carried along to be wound on the rewinding reel 24. The complete recovery of the master 4 from the drum is performed within a time corresponding to a rotation of the cam shaft slightly less than 180°.

During the operation of recovery by the continuous advance of band 20, the front or leading edge of the fresh master 4, which is transported by the band 20, is gradually unwound from the feed reel 23 and advances along the course 197 shown in thick dashes in FIG. 2 and, at the end of the recovery operation, it is close to the sensor of the microswitch 157.

At the end of a complete revolution of the shaft 142 actuated by the coupling 145, the coupling itself reopens, since, the action of energization of the electromagnet 156 having ceased when the operator has released the key, the lever 151 continues to slide on the periphery of the coupling 145 until, a revolution of the latter having been completed, the lever engages the dog 150, producing the opening or disengagement of the coupling 145.

With the reopening of the coupling 145, the master recovery operations are at an end and stopping of the rotation of the cam shaft 126 takes place in a position turned through 180° with respect to the inoperative position because of the transmission ratio between the gears 140 and 141, while the rewinding reel 24, the rollers 44 and the rollers 109 continue their movement. The band 20 therefore continues to unwind from the reel 23 and to be rewound on the reel 24.

With the unwinding of the band 20, the fresh master 4 also unwinds from the reel 23 and, as already stated, advances guided by the band 20, below it and substantially adhering thereto, along the path 197 and strikes the sensor 158 of the microswitch 157 with its front edge, causing the energization of the electromagnet 156 and, therefore, the reclosing of the coupling 145 and therefore a fresh rotation of the shaft 142 for one revolution.

The cam shaft 126 therefore starts to rotate again, while the leading edge of the fresh master comes into correspondence with the end 19 of the opening 18 of the cartridge 1, where, as already described, the support band 20 undergoes an abrupt change of direction and, because of this, there is obtained the separation of the support band 20 from the master, which, on the other hand, advances into the gap 67, being pushed by the rollers 44, while, in view of its length, its rear edge is still wound on the reel 23. In the meantime, because of the rotation of the cam 122, the stud 174 of the lever 112 engages with the circular arc 131 of the profile of the said cam and the rollers 109 are therefore raised with respect to the shell of the drum 3.

After a rotation of the cam shaft 126 corresponding to the time that the leading edge of the fresh master 4 takes to cover the distance between the sensor 158 of the microswitch 157 and the surface 74 of the shaped portion 73 of the drum 3, the stud 170 of the lever 81 travels over the descending step 136 of the cam 121 and the consequent rotation of the lever causes the lever 100 to disengage itself from the control lug 102 of the coupling 105, which is therefore closed and permits transmission of the rotary motion to the drum 3 in the manner hereinbefore described.

The drum 3, being set in rotation, carries with it the lever 160, the stud 161 of which is therefore compelled to reascend from the gap 128 in the fixed cam 124 by way of the slope 130 and engage the circular portion of the cam. To this there corresponds an anticlockwise rotation of the spindle 83 fast with the said lever and, therefore, also of the plates 92 fixed to the spindle, which, by means of the springs 93, also set the clamps 80 in anticlockwise rotation until the gripping elements 89 come into contact with the leading edge of the fresh master positioned on the surface of the shaped portion 73. At this point, the further rotation of the spindle 83 causes the stretching of the springs 93 and, therefore, a pressure of the gripping elements 89 on the master sheet 4, which thus remains clamped firmly to the drum. The rotation of the drum continuing, the master sheet 4 is wound progressively around its peripheral surface, guided in this operation by the wires 182 until the master is fully wound around the drum. The drum performs a complete revolution on itself in the time in which the cam shaft 126 performs its second revolution of 180°; during this revolution, therefore, each of the cams returns to its starting position and the following are obtained in succession:

— return of the active profile of the cam 123 to correspond with the gap 128 in the fixed cam 124, which will prevent reopening of the clamps on passage of the stud 161 of the lever 160 into correspondence with the aforesaid gap;

— reopening or disengagement of the coupling 63 actuated by the cam 120, which causes the arrest of the movement of the rollers 44 and 109, and finally, at the end of a 360° revolution of the drum 3, the reopening of the coupling 105, through the action of the cam 121, which brings the lever 100 back into engagement with the lug 102 of the coupling 105, with consequent stopping of the drum 3.

With the stopping of the drum 3, the master changing cycle in the reprographic machine 2 is at an end, so that the normal reproduction operations can be resumed, during which the reclosing of the coupling 105 for transmitting the motion thereto will be effected by means of the electromagnet 180 and the lever 100.

For the purpose of indicating to the operator that the fresh master which is fed is the last available on the reel 23 of the cartridge, a counter not shown in the drawing and actuated by the microswitch 157 may be provided, the counter being incremented as each fresh master 4 is fed and lighting a suitable signal lamp not shown in the drawing when the count has reached the number of masters normally available on the reel 23 of the cartridge 1.

A variation in the embodiment hereinbefore described may be to limit the parts replaced by changing the cartridge by pivoting the casing of the cartridge 1 formed by the integral containers 5 and 6 on the pin 31 by widening the openings 17 and 18 of the containers 5 and 6 providing in known manner for pivoting the cylinders 13 and 14 removably for the purpose of effecting the changing only of the reels 23 and 24 and of the respective cylindrical cores 13 and 14 without replacing the containers 5 and 6 each time.

What I claim is:

1. An automatic sheet changing system for a reprographic machine comprising:

a sheet receiving member;

retaining means actuatable for retaining a sheet onto said sheet receiving member;

a feed reel;

a take-up reel;

a flexible support wound from said feed reel to said take-up reel;

a plurality of sheets positioned regularly spaced on said support and interwound with the support on said feed reel;

means mounting said feed reel and said take-up reel on the machine with the portion of said flexible support extending from the feed reel to the take-up reel passing adjacent the gripping elements of said receiving member;

means operative in a sheet changing cycle for removing a used sheet from the sheet receiving member;

means operative during said cycle for advancing a predetermined length of flexible support along said path by unwinding it from the feed reel and rewinding it to the take-up reel;

means for separating a fresh sheet advancing with the support along said path during said cycle and for guiding the fresh sheet to the retaining elements; and means for actuating the retaining elements to retain the fresh sheet.

2. System according to claim 1, wherein the removing means comprise means for deactivating the retaining means, means for advancing the used sheet, positioned on the sheet-receiving member, along a portion of the support running to the take-up reel until it is linked up with the take-up reel, the winding of the support on the take-up reel guiding the recovered sheet to become wound on the take-up reel.

3. System according to claim 2, wherein the feed and take-up reels belong to a single cartridge positioned removable on the machine.

4. System according to claim 2, wherein the length of the portion of the support between two consecutive sheets interwound on the feed reel is greater that the length of the portion of the support is contact with one of the sheets.

5. System according to claim 4, wherein the said cycle begins with the recovery of the used sheet from the sheet-receiving member, the feed means unwinding a portion of the support interposed between two sheets from the feed reel during the removing operation.

6. System according to claim 5, wherein the feed means are active and unwind the support from the feed reel without and break of continuity during the said cycle.

7. System according to claim 5 wherein the sheet receiving member is movable along an endless path in the machine and receives its motion from a motor in the machine through a coupling device adapted to be engaged selectively, and wherein means are provided for maintaining the coupling disengaged during the removing operaton and for engaging the coupling on arrival of a sheet adjacent the retaining means during the feed operation.

8. System according to claim 7, wherein the sheet-receiving member is a drum on the periphery of which the sheet is wound, being retained by the gripping elements, and wherein the advancing means comprise a first plurality of rollers pivoted inside the drum on spindles fast with the drum and adapted to rotate through openings formed in the periphery of the drum and tangentially to this periphery, and a second plurality of driving rollers pivoted outside the drum in correspondence with the rollers of the first plurality and movable between a first uncoupling position and a second position in which they co-operate with the rollers of the first plurality to advance the sheet wound around the drum and interposed between the first and second pluralities of rollers towards the portion of support running to the take-up reel, means being provided for moving the second plurality of rollers into the coupling position and for deactuating the gripping elements at the beginning of the removing operation.

9. System according to claim 8, wherein the retaining means comprise a plurality of clamps mounted of the said drum, and the said actuating means comprise a cam mounted fixedly on the machine and a lever connected to the movable parts of the clamps and cooperating with the profile of the cam to effect the closing of the clamps at the beginning of a rotation of the drum.

10. An automatic sheet changing system for a reprographic machine comprising:

a sheet receiving member;

retaining means actuatable for retaining a sheet onto said sheet receiving member;

a cartridge removable positioned in the machine including:

a feed reel and a take-up reel;

a flexible support wound from said reel to said take-up reel; and a plurality of sheets positioned regularly spaced on said support and interwound with said support on said feed reel;

means removably mounting said cartridge on the machine with the portion of said flexible support extending from the feed reel to the take up reel passing adjacent the gripping elements of said holding member;

means operative in a sheet changing cycle to remove a used sheet from the sheet holding member;

means operative with the cartridge inserted and during said cycle for advancing a predetermined length of flexible support along said path by unwinding it from the feed reel and rewinding it to the take-up reel;

means for separating a fresh sheet advancing with the band along said path during said cycle and for guiding the fresh sheet to the gripping elements; and means for actuating the gripping elements to grip the fresh sheet.

* * * * *